US008166585B2

(12) United States Patent
Settgast et al.

(10) Patent No.: US 8,166,585 B2
(45) Date of Patent: May 1, 2012

(54) MEDICAL WORKSTATION FOR PATIENTS

(75) Inventors: Dieter Settgast, Lübeck (DE); Sven Pasdzior, Lübeck (DE); Claus Bunke, Sereetz (DE); Gerald Panitz, Klenzau (DE); Jürgen Manigel, Scharbeutz (DE); Hermann Hopermann, Badendorf (DE); Kay Frensch, Klingberg/Scharbeutz (DE); Martin Wunderlich, Lübeck (DE)

(73) Assignee: Dräger Medical GmbH, Lübeck (DE)

( * ) Notice: Subject to any disclaimer, the term of this patent is extended or adjusted under 35 U.S.C. 154(b) by 427 days.

(21) Appl. No.: 12/206,948

(22) Filed: Sep. 9, 2008

(65) Prior Publication Data

US 2009/0070934 A1 Mar. 19, 2009

(30) Foreign Application Priority Data

Sep. 13, 2007 (DE) ..... 10 2007 043 232

(51) Int. Cl.
*A47B 71/00* (2006.01)

(52) U.S. Cl. ..... 5/600; 5/503.1; 5/658; 340/286.07

(58) Field of Classification Search ..... 5/600, 110, 5/503.1, 658; 709/201; 340/286.07
See application file for complete search history.

(56) References Cited

U.S. PATENT DOCUMENTS

| | | | | |
|---|---|---|---|---|
| 3,267,955 | A * | 8/1966 | Logan et al. | 137/357 |
| 6,279,183 | B1 * | 8/2001 | Kummer et al. | 5/600 |
| 6,481,688 | B1 * | 11/2002 | Welling et al. | 248/694 |
| 7,065,812 | B2 | 6/2006 | Newkirk et al. | |
| 7,321,811 | B1 * | 1/2008 | Rawls-Meehan | 700/302 |
| 2006/0107463 | A1 | 5/2006 | Foster et al. | |
| 2006/0179571 | A1 * | 8/2006 | Newkirk | 5/600 |

FOREIGN PATENT DOCUMENTS

| | | |
|---|---|---|
| DE | 42 28 873 | 10/1993 |
| EP | 1 690 517 | 8/2006 |

* cited by examiner

*Primary Examiner* — Robert G Santos
*Assistant Examiner* — Nicholas Polito
(74) *Attorney, Agent, or Firm* — McGlew and Tuttle, P.C.

(57) ABSTRACT

A medical workstation and workstation system for patients includes a bed for positioning the patient in the lying position, a plurality of mobile work units, which are connected to the bed, a control unit, which is arranged at the bed and which can be connected via a first supply cable to a stationary media port, on the one hand, and via a second supply cable to a mobile media port, on the other hand, for supplying a work unit. The control unit is designed as a distribution unit, to which a plurality of mobile work units (4, 4') are connected via connection cables.

22 Claims, 1 Drawing Sheet

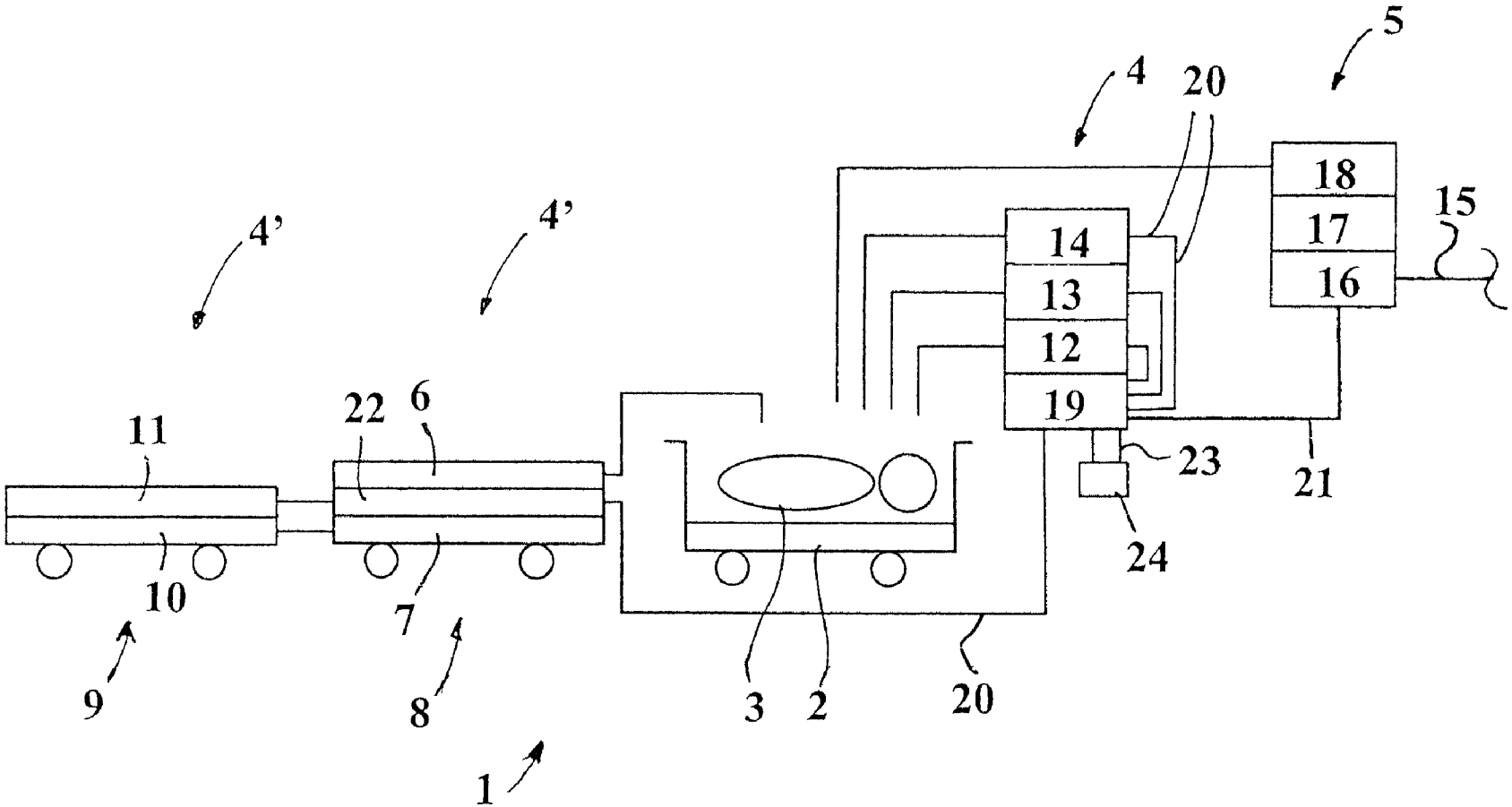
5
15
18
17
16
21
20
23
24
4
14
13
12
19
20
2
3
4'
1
6
7
8
22
4'
11
10
9

MEDICAL WORKSTATION FOR PATIENTS

CROSS REFERENCE TO RELATED APPLICATIONS

This application claims the benefit of priority under 35 U.S.C. §119 of German Patent Application DE 10 2007 043 232.3 filed Sep. 13, 2007, the entire contents of which are incorporated herein by reference.

FIELD OF THE INVENTION

The present invention pertains to a medical workstation for patients with a bed for positioning the patient in the lying position; with a plurality of mobile work units connected to the bed; with a control unit, which is arranged at the bed and which can be connected via a first supply cable to a stationary media port for gas and/or energy and/or data, on the one hand, and, on the other hand, via a second supply cable to a corresponding mobile media port for supplying a work unit designed, e.g., as a ventilation unit (also known as a respiration unit).

BACKGROUND OF THE INVENTION

A medical workstation for patients, in which a plurality of mobile work units permanently connected to a patient bed are arranged at a patient bed, is known from US 2006/0107463 A1. The mobile work units are designed, for example, as an operating/display unit or as a ventilation unit. To reduce the necessary amount of work in connection with the preparation and transportation of the patient bed with a patient in it, a control unit is arranged at the bed, and the control unit can be connected via a first supply cable to a stationary media port, on the one hand, and, on the other hand, via a second supply cable to a mobile media port, so that supply for the mobile work unit is always guaranteed.

SUMMARY OF THE INVENTION

The object of the present invention is to perfect a medical workstation for patients such that the amount of work needed for transporting a bed with a patient in it is further reduced.

According to the invention, a medical workstation for patients is provided with a bed for positioning the patient in the lying position, with a plurality of mobile work units connected to the bed and with a control unit, which is arranged at the bed and which can be connected via a first supply cable to a stationary media port, on the one hand, and via a second supply cable to a mobile media port for supplying a work unit, on the other hand. The control unit is designed as a distribution unit, to which a plurality of the mobile work units are connected via connection cables.

The special advantage of the present invention is that by providing a distribution unit, a plurality of mobile work units can remain in the operating state during transportation. The mobile work units may be positioned directly at the bed or at a mobile cart. Only a system cable of a stationary operating unit must be disconnected from the distribution unit for transportation. Due to the fact that the necessary mobile work units are already in the operating state, due to coupling to the distribution unit for transporting the bed, the times needed for preparation for transportation can be reduced. Interruption-free therapy is achieved during the entire transportation time and the set-up times are minimized.

According to a preferred embodiment of the present invention, the mobile work units are each connected to the distribution unit via a system cable by a plug-type connection. The system cable contains an energy supply line, on the one hand, and a data line for bidirectional data exchange, on the other hand. Operation of the mobile work units can be advantageously guaranteed hereby in a site-independent manner. On the other hand, data exchange with corresponding stationary work units is guaranteed at the beginning or at the end of the transportation time.

According to a variant of the present invention, the distribution unit has an interface, so that another distribution unit can be coupled. Additional mobile work units can be advantageously connected as a result.

According to a variant of the present invention, a central operating/display unit is provided as the only stationary work unit. Only the system cable leading from the central operating/display unit to the distribution unit needs to be disconnected for transporting the bed. The preparations for transport can be further minimized as a result.

An exemplary embodiment of the present invention will be explained in more detail below on the basis of the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

The only drawing is a schematic block diagram of a medical workstation for patients according to the invention.

DESCRIPTION OF THE PREFERRED EMBODIMENTS

Referring to the drawings in particular, a medical workstation 1 for patients comprises essentially a bed 2 for positioning a patient 3 in the lying position, a plurality of mobile work units 4, 4' connected to the bed 2, and at least one stationary work unit 5 connected to the bed 2.

The mobile work units 4' may be designed, for example, as a ventilation unit 6 and as a supply unit 7, which are arranged on a common cart 8. An additional distribution unit 10 and a monitor 11 may be arranged on a separate additional cart 9, the supply unit 10 being used to supply the ventilation unit 6 with gas and electricity during transportation. Other mobile work units 4, for example, relatively small portable monitors 12, a patient monitoring unit 13 and a ventilation unit 14, may be fastened immediately and directly to the bed 2.

The above-mentioned mobile work units 4, 4' are thus located in an area close to the patient. The bed 2 of patient 3 may be designed, for example, as a patient bed or as a thermotherapy bed or as an operating table or other patient conveying devices.

A distribution unit 19, which preferably forms a common assembly unit with a carrier means for the monitor 12 directly assigned to the bed 2, is provided for operating the mobile work units 4, 4' as well as at least the stationary work unit 5, which may be designed as a central operating/display unit 16 and/or as a ventilation unit 17 and/or as a gravitational infusion unit 18.

The mobile work units 4, 4' directly assigned to the bed 2 are connected to the distribution unit 19 via a connection cable 20 each. The connection cable 20 may be designed as a system cable, which contains the energy supply line, on the one hand, and a data line for bidirectional data exchange, on the other hand. The distribution unit 19 is coupled with the stationary work units 5 via a system cable 21, so that data exchange is guaranteed between the mobile work units 4, 4', on the one hand, and the stationary work unit 5, on the other hand.

In order to also enable the mobile work units 4', which are not coupled directly with the bed 2 and are arranged on the carts 8, 9, to exchange data, cart 8 has a distributor 22, via which the monitor 11 is coupled with the distribution unit 19.

The distribution unit 19 has a modular design, and another distribution unit 24 can be coupled via an interface 23. Additional mobile work units can be connected in this manner.

The central operating/display unit 16 is preferably connected to a data network 15. An exchange of patient data can thus take place independently from the location of the patient bed 2.

The distribution unit 19 has a plurality of slots, so that plugs of the mobile work units 4, 4' can be connected in a confusion-proof manner. The mobile work units 4, 4' are operated via the supply unit 10 during transportation of the bed 2. After disconnecting the system cable 21, the supply of the mobile work units 4, 4' is changed automatically over to the supply unit 10. Recharging of batteries of the supply unit 10 does not take place during transportation.

While specific embodiments of the invention have been shown and described in detail to illustrate the application of the principles of the invention, it will be understood that the invention may be embodied otherwise without departing from such principles.

What is claimed is:

1. A medical workstation for patients, the medical workstation comprising:

a bed for positioning a patient in a lying position, said bed being mounted for movement such that said bed moves between a stationary state and a transporting state;

a plurality of mobile work units connected to said bed;

one or more system connection cables;

stationary work units, at least one of said stationary work units comprising a stationary media port; and a control unit arranged at said bed for movement therewith, said control unit comprising a distribution unit, said plurality of mobile work units being connected via said connection cables to said distribution unit with said bed in said transporting state and said stationary state, said control unit being connected via a first supply cable to said stationary media port and via a second supply cable to a mobile media port of at least one of said mobile work units with said bed in said stationary state for supplying one or more of said mobile work units, said distribution unit connecting said stationary work units with said mobile work units such that data is bidirectionally exchanged between at least one of said stationary work units and at least one of said mobile work units, said control unit being disconnected from said stationary media port with said bed in said transporting state, said stationary media port not being connected to said bed in said transporting state, wherein said stationary media port is in a fixed position such that said stationary media port does not move with respect to said bed and said plurality of mobile work units, said plurality of mobile work units being movable with said bed in said transporting state, at least one of said mobile work units being independently movable with respect to said bed with at least said bed in said transporting state, one of said mobile work units being attached to a first mobile cart, another one of said mobile work units being attached to a second mobile cart, said one of said mobile work units being connected to said another one of said mobile work units.

2. A medical workstation in accordance with claim 1, wherein one or more of said mobile work units are attached directly to said bed or to a mobile cart, at least one of said mobile work units comprising a supply unit, one or more said mobile work units being operated via said supply unit in said transporting state, at least one of said mobile work units being located at a spaced location from said bed.

3. A medical workstation in accordance with claim 1, wherein said mobile work units are connected via said system connection cables to said distribution unit by a plug-type connection, wherein an energy supply line and a data line for bidirectional data exchange are integrated in each of said system cables.

4. A medical workstation in accordance with claim 1, wherein said distribution unit defines means for a bidirectional data exchange between said mobile work units and said corresponding stationary work units.

5. A medical workstation in accordance with claim 1, further comprising:

an additional distribution unit wherein said distribution unit includes an interface, said additional distribution unit being coupled with said interface of said distribution unit for connecting additional said mobile work units.

6. A medical workstation in accordance with claim 4, wherein only one of said stationary work unit is connected to said distribution unit.

7. A medical workstation in accordance with claim 6, wherein a central operating/display unit is connected to a data network.

8. A medical workstation in accordance with claim 1, wherein said distribution unit forms an assembly unit with a carrying means for carrying one of said mobile work units, said one of said mobile work units comprising a monitor.

9. A medical workstation in accordance with claim 1, wherein at least one of said mobile work units is a patient monitoring unit, a ventilation unit, an infusion pump unit, a display unit, a gravitational infusion unit or a supply unit.

10. A medical workstation in accordance with claim 1, wherein said distribution unit comprises a multi-plug interface wherein said mobile work units can be plugged into the workstation independently from one another.

11. A medical workstation in accordance with claim 4, wherein data is exchanged between at least one of said mobile units and at least one of said stationary units at a beginning or at an end of a transportation time, said one of said mobile work units comprising a mobile work unit distribution unit and one or more of a ventilation unit and a supply unit, said another one of said mobile work units comprising one or more of another supply unit and a monitor, said mobile work unit distribution unit being connected to said distribution unit, said bed being independently movable with respect to one or more of said mobile work units with said bed in said transporting state.

12. A medical workstation system for patients, the medical workstation system comprising:

a bed for positioning a patient in a lying position, said bed being mounted for movement such that said bed moves between a stationary position and a transporting state;

a plurality of mobile work units connected to said bed, at least one of said mobile work units comprising a supply unit, one or more said mobile work units being movable with respect to said bed with at least said bed in said transporting state, at least one of said mobile work units comprising a mobile media port;

one or more system connection cables;

a control unit arranged at said bed for movement therewith, said control unit comprising a distribution unit, said plurality of mobile work units being connected via said system connection cables to said distribution unit with said bed in said stationary position and said transporting state;

a plurality of stationary work units, at least one of said stationary work units comprising a stationary media port;

a first supply cable; and a second supply cable, said control unit having at least one connection to said stationary media port and said mobile media port for connecting one or more of said work units with said bed in said stationary position, said distribution unit exchanging data bidirectionally between at least one of said mobile work units and at least one of said stationary work units in said stationary state, said at least one connection comprising a connection via said first supply cable to said stationary media port and a connection via said second supply cable to said mobile media port in said stationary position, said control unit being disconnected from said stationary media port with said bed and said plurality of work units in said transporting state, said stationary media port being disconnected from said bed in said transporting state and said stationary position, wherein said stationary media port is not movable with respect to said bed and said plurality of mobile work units, said control unit being connected to said mobile media port via said second supply cable with said bed in said transporting state and with said bed in said stationary position, wherein said plurality of mobile units are operated via said supply unit in said transporting state, one of said mobile work units being attached to a first mobile cart, another one of said mobile work units being attached to a second mobile cart, said first mobile cart being connected to said second mobile cart via said one of said mobile work units and said another one of said mobile work units.

13. A medical workstation system in accordance with claim 12, wherein one or more of said mobile work units are attached directly to said bed or to a mobile cart, at least one of said mobile work units not being arranged on said bed, said at least one of said mobile work units being located at a spaced location from said bed.

14. A medical workstation system in accordance with claim 12, wherein said mobile work units are connected via said system connection cables to said distribution unit by a plug-type connection, wherein an energy supply line and a data line for bidirectional data exchange are integrated in each of said system cables.

15. A medical workstation system in accordance with claim 12, wherein said distribution unit defines a means for a bidirectional data exchange between said mobile work units and said corresponding stationary work units, at least one of said mobile work units being attached directly to said bed, at least another one of said mobile work units being attached to a mobile cart.

16. A medical workstation system in accordance with claim 12, further comprising:

an additional distribution unit wherein said distribution unit includes an interface, said additional distribution unit being coupled with said interface of said distribution unit for connecting additional said mobile work units.

17. A medical workstation system in accordance with claim 15, wherein only one said stationary work unit is connected to said distribution unit.

18. A medical workstation system in accordance with claim 17, wherein a central operating/display unit is connected to a data network.

19. A medical workstation system in accordance with claim 12, wherein said distribution unit forms an assembly unit with a carrying means for carrying one of said mobile work units, said one of said mobile work units comprising a monitor.

20. A medical workstation system in accordance with claim 12, wherein at least one of said mobile work units is a patient monitoring unit, a ventilation unit, an infusion pump unit, a display unit, a gravitational infusion unit or a supply unit.

21. A medical workstation system in accordance with claim 12, wherein said distribution unit comprises a multi-plug interface wherein said mobile work units can be plugged into the workstation independently from one another.

22. A medical workstation for patients, the medical workstation comprising:

a bed for positioning a patient in a lying position, said bed being mounted for movement such that said bed moves between a stationary position and a transporting state;

a plurality of mobile work units connected to said bed, at least one of said mobile work units comprising a supply unit, one or more said mobile work units being movable with respect to said bed with at least said bed in said transporting state, at least one of said mobile work units comprising a mobile media port;

one or more system connection cables;

a control unit arranged at said bed for movement therewith, said control unit comprising a distribution unit, said plurality of mobile work units being connected via said system connection cables to said distribution unit with said bed in said stationary position and said transporting state;

a plurality of stationary work units, at least one of said stationary work units comprising a stationary media port;

a first supply cable; and a second supply cable, said control unit having at least one connection to said stationary media port and said mobile media port for connecting one or more of said work units with said bed in said stationary position, said distribution unit exchanging data bidirectionally between at least one of said mobile work units and at least one of said stationary work units in said stationary state, said at least one connection comprising a connection via said first supply cable to said stationary media port and a connection via said second supply cable to said mobile media port in said stationary position, said control unit being disconnected from said stationary media port with said bed and said plurality of work units in said transporting state, said stationary media port being disconnected from said bed in said transporting state and said stationary position, wherein said stationary media port is not movable with respect to said bed and said plurality of mobile work units, said control unit being connected to said mobile media port via said second supply cable with said bed in said transporting state and with said bed in said stationary position, wherein said plurality of mobile units are operated via said supply unit in said transporting state, wherein data is exchanged between at least one of said mobile units and at least one of said stationary units at a beginning or at an end of a transportation time, one of said mobile work units being attached to a first mobile cart, another one of said mobile work units being attached to a second mobile cart, said first mobile cart being connected to said second mobile cart via said one of said mobile work units and said another one of said mobile work units, said one of said mobile work units comprising a mobile work unit distribution unit and one or more of a ventilation unit and a supply unit, said mobile work unit distribution unit being connected to said distribution unit, said another one of said mobile work units comprising one or more of another supply unit and a monitor, said bed being independently movable with respect to one or more of said mobile work units with said bed in said transporting state, said one or more said mobile work units being movable with respect to said bed with said bed in said stationary position.

* * * * *